US010293355B2

(12) United States Patent
Barron

(10) Patent No.: US 10,293,355 B2
(45) Date of Patent: May 21, 2019

(54) METHOD FOR DISPENSING LIQUID INGREDIENTS FROM A TUBULAR BAG IN A METERED MANNER, AND MEANS FOR CARRYING OUT THE METHOD

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 126 days.

(21) Appl. No.: 15/031,828

(22) PCT Filed: Sep. 30, 2014

(86) PCT No.: PCT/EP2014/070888
§ 371 (c)(1),
(2) Date: Apr. 25, 2016

(87) PCT Pub. No.: WO2015/058933
PCT Pub. Date: Apr. 30, 2015

(65) Prior Publication Data

US 2016/0263599 A1 Sep. 15, 2016

(30) Foreign Application Priority Data

Oct. 25, 2013 (DE) ..... 10 2013 221 706

(51) Int. Cl.
*B05B 11/00* (2006.01)
*B05B 9/04* (2006.01)
(Continued)

(52) U.S. Cl.
CPC ..... *B05B 11/00412* (2018.08); *B05B 9/043* (2013.01); *B05B 9/047* (2013.01);
(Continued)

(58) Field of Classification Search
CPC ..... B05B 11/0043; B05B 11/3047; B05B 11/0072; B05B 9/0416; B05B 9/047;
(Continued)

(56) References Cited

U.S. PATENT DOCUMENTS 4,921,135 A * 5/1990 Pleet ..... B67B 7/26 222/105
5,205,440 A * 4/1993 Matsushita ..... B67D 1/0462 222/496
(Continued)

FOREIGN PATENT DOCUMENTS

CN 1267269 A 9/2000
CN 1743239 A 3/2006
(Continued)

OTHER PUBLICATIONS

International Search Report for Application No. PCT/EP2014/070888 dated Jan. 5, 2015 (English Translation, 2 pages).

*Primary Examiner* — Paul R Durand
*Assistant Examiner* — Robert K Nichols, II
(74) *Attorney, Agent, or Firm* — Michael Best & Friedrich LLP

(57) ABSTRACT

The invention relates to a method for dispensing viscous or pasty ingredients (12), which are packaged in an aseptic manner, from a tubular bag (1), which is closed prior to the first use, by means of a disposable pump (4) attached to the bag. The disposable pump (4) has an inlet (5) with a cutting element (6), and a nozzle (2) with a flange (3) is welded onto the tubular bag (1). The disposable pump (4) is rotated relative to the nozzle (2), and the tubular bag (1) is thereby cut open. A valve (9) is arranged in the region of the outlet opening of an outlet tube (8) of the pump, and the disposable pump (4) is operated after the initial opening process until a freely selectable volume has exited the closing valve. The disposable pump (4) is then operated in the opposite rota-
(Continued)

tional direction in order to suction ingredients (12) present on or in the region of the valve (9) back into the outlet tube (8). In the process, the valve (9) reaches or remains in the closed valve state. A valve (9) is proposed for carrying out the method. The valve is arranged in the outlet tube (8) and comprises a membrane (93, 191) which is sealingly mounted in a sliding manner or can be inverted. Using the method, the ingredients (12) can be dispensed in a metered manner from a tubular bag (1), in which the ingredients are aseptically packaged, into virtually aseptic containers until the ingredients are practically completely used.

8 Claims, 5 Drawing Sheets

(51) Int. Cl.
*B05B 9/043* (2006.01)
*B05B 9/047* (2006.01)

(52) U.S. Cl.
CPC ..... *B05B 9/0416* (2013.01); *B05B 11/007* (2013.01); *B05B 11/0072* (2013.01); *B05B 11/3047* (2013.01)

(58) Field of Classification Search
CPC ... B05B 9/043; B05B 11/007; B05B 11/3097; B05B 11/00412; B05B 11/00414; F04C 5/00; F04C 11/005; B65D 47/06
USPC ..... 222/80–83, 571, 494
See application file for complete search history.

(56) References Cited

U.S. PATENT DOCUMENTS

| | | | | |
|---|---|---|---|---|
| 5,934,509 | A * | 8/1999 | Niss | A21C 15/005 222/81 |
| 5,971,207 | A * | 10/1999 | McDonough | B05B 7/1445 222/1 |
| 8,096,530 | B2 * | 1/2012 | Pelfrey | A47K 5/16 222/139 |
| 8,348,104 | B2 * | 1/2013 | Py | B65D 75/5866 222/105 |
| 8,752,732 | B2 * | 6/2014 | Evans | A47K 5/1215 222/1 |
| 2005/0087555 | A1 * | 4/2005 | Hatton | A47K 5/1208 222/209 |
| 2007/0000941 | A1 * | 1/2007 | Hadden | A47K 5/1217 222/52 |
| 2011/0031273 | A1 * | 2/2011 | Macler | B65D 25/48 222/81 |
| 2011/0121028 | A1 | 5/2011 | Rusch | |
| 2012/0248149 | A1 | 10/2012 | Pelfrey | |
| 2014/0048557 | A1 * | 2/2014 | Barron | B65D 5/748 222/81 |

FOREIGN PATENT DOCUMENTS

| | | | |
|---|---|---|---|
| CN | 101678914 | A | 3/2010 |
| EP | 0743259 | A1 | 11/1996 |
| EP | 1958883 | A1 | 8/2008 |
| WO | 2013135434 | | 9/2013 |

* cited by examiner

METHOD FOR DISPENSING LIQUID INGREDIENTS FROM A TUBULAR BAG IN A METERED MANNER, AND MEANS FOR CARRYING OUT THE METHOD

BACKGROUND OF THE INVENTION

The present invention relates to a method for dispensing viscous or pasty ingredients, which are packaged in an aseptic manner, from a tubular bag, which is closed prior to the first use, by means of a disposable pump attached to the bag, the inlet of which comprising a cutting element is connected to the pump in a rotationally fixed manner, wherein the inlet comprising the cutting element has an external thread, which is connected in a nozzle comprising a flange, said nozzle being mounted to the tubular bag, and wherein the outlet of the pump is provided with an outlet tube comprising a valve which closes in a sealing manner, wherein, in a first step prior to the first metering operation, the pump comprising the cutting element is rotated until the cutting element has cut open the tubular bag.

In the food service industry, the health and purity regulations and requirements are of greatest importance. Liquid and pasty foodstuffs, which are dispensed in a metered manner, play a major role in this regard. Mayonnaise, ketchup and tartar sauces are particularly dispensed in a metered manner in large quantities in the area of fast food restaurants. In the conventional food service industry, salad dressings are likewise similarly dispensed in a metered manner.

To this end, so-called tubular bags have also been available for the past few years. Such liquid or pasty foodstuffs have been aseptically packaged in these tubular bags and are thus aseptically delivered. Up until now, a bung has been pushed through a flange comprising a sleeve during the initial opening of the tubular bag, and said bung has been mechanically fixed. A tube has been attached to the bung. The tube is then connected to a metering pump, which is either mechanically operated or operated by means of a motor, wherein the metering pump dispenses the foodstuff in a metered manner.

The installation of the bung alone allows air to enter into the tubular bag and thus also bacteria, which are then the source of microbial growth. Residual quantities of the metered foodstuff also remain hanging at the outlet of the metering apparatus downstream of the pump and are exposed to the ambient air, and thus a contamination of said apparatus can practically never be ruled out.

In contrast to bottles or solid plastic containers, the tubular bags are absolutely limp and a vacuum, which causes the dispensed material to be suctioned back, does not even result in the tubular bag from the dispensed material. The applicant himself has registered different metering devices for patent and put said devices on the market. These devices include a disposable pump which is suitable for attaching to a tubular bag.

By means of the combined tubular bag comprising a disposable pump, which is provided by the applicant, a tubular bag can be opened such that the aseptic contents are not contaminated in the process. Up until now, the problem of a certain residual amount of the foodstuff remaining in the region of the outlet tube after each metering operation had not been solved. Even the installation of a valve at the end of the outlet tube does not prevent residual amounts of foodstuffs from remaining hanging in the region of this valve. As a result, a contamination of this residual amount of foodstuff could not be prevented until now. Membrane valves are, of course, readily available on the market, which for the most part close tightly and cleanly; however, minimal residual amounts of foodstuff could not be prevented to date.

SUMMARY OF THE INVENTION

It is therefore the aim of the present invention to solve the problem mentioned above. This problem is solved on the one hand by a method, wherein furthermore a) the pump is operated until the contents of a predefinable metered volume have escaped from the closing valve;

b) the pump is operated thereafter in the opposite direction of rotation until at least the ingredients present in the region of the valve are suctioned back into the outlet tube and the valve thereby reaches or remains in the closed state.

The volume to be suctioned back per se is extremely small. The pump being operated in the opposite direction of rotation as a function of the amount of foodstuff to be suctioned back would be very difficult, practically impossible. If, however, more is suctioned back than there is material to be suctioned back, air will consequently be drawn into the outlet tube. After an extended period of non-use overnight, at least one metering operation should then be carried out on the following day without using the metered contents as a precaution. In order to prevent air from being drawn back into the outlet tube, provision is advantageously made for the valve in the closed state to be suctioned back within the outlet tube into the disposable pump by displacing or deforming the valve, thereby displacing ingredients by a portion of the outlet volume as a back suction volume.

In principle, the entire volume of the outlet tube could be suctioned back. This would, however, in turn require an extremely accurate control of the disposable pump; and in order to prevent this condition, the method is preferably operated in such a way that the back suction volume is kept smaller than the volume of the outlet tube, in particular less than 10% of the volume of the outlet tube.

In addition, a tubular bag comprising a pump is proposed for carrying out the method, wherein the valve in the outlet tube comprises a membrane which is sealingly mounted in a sliding manner or can be inverted.

BRIEF DESCRIPTION OF THE DRAWINGS

Further advantageous forms of the method and the tubular bag comprising the pump for carrying out the method ensue from the dependent patent claims; and the relevance and effect of said forms are explained in the following description with reference to the attached drawings. In the drawings:

FIG. 2 shows a nozzle with a flange to be applied to the tubular bag and the corresponding disposable pump prior to installation, while

FIG. 8 shows a variant of the valve which is suited to carrying out the method, said valve being disposed in the outlet tube in a positionally fixed manner, wherein FIG. 8 shows a position in the back suctioned state; whereas

DETAILED DESCRIPTION

Figure 1:
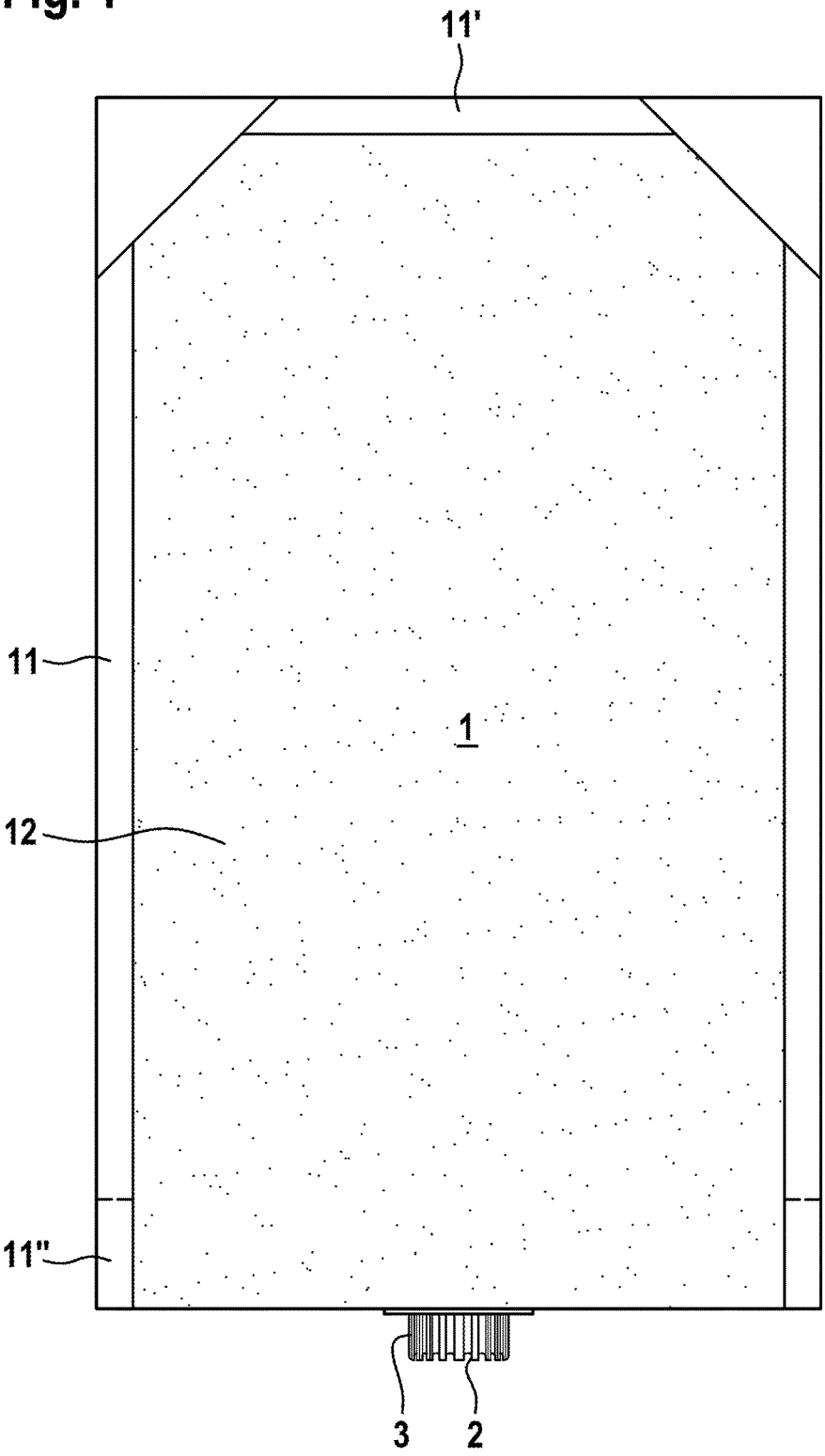
FIG. 1 shows a possible embodiment of a tubular bag which is suitable for the method and comprises a nozzle and flange that are already mounted.

In order to explain the method, the means known per se which are used to this end are first briefly described. In this case, said means known per se relate to a tubular bag 1 in which ingredients 12 are packaged in an aseptic manner. The tubular bag can, of course, have a variety of embodiments. In FIG. 1, a very simple embodiment which is known per se is, however, depicted. The tubular bag 1 is sealed on all sides by means of welded seams 11, and the ingredients 12 are then introduced during the production of the tubular bag. The front wall and the back wall lying behind it are connected to one another via the lateral welded seams 11. A fold is formed in the lowermost region, wherein four film layers lie on top of each other in the region 11". In this way, a base surface 15 is formed on which the nozzle 2 with a flange 3 is welded. The tubular bag 1 is now filled with the ingredients 12 and as soon as the desired fill quantity is achieved, the upper welded seam 11' is applied to the tubular bag 1. This operation can take place in such a way that a trapped residual amount of air can still be suctioned off when welding said upper seam. As soon as the upper welded seam 11' is sealed, the ingredients 12 are aseptically packaged.

In this context, the general term "ingredients" is used and this particularly stands for viscous and pasty foodstuffs, such as, for example, edible oil, dairy products, salad dressings or other sauces used in the food service industry or pasty foodstuffs, such as mayonnaise, ketchup, tartar sauce, various fruit pulp pastes, as they are added to ice cream in ice cream parlors.

Figure 2:
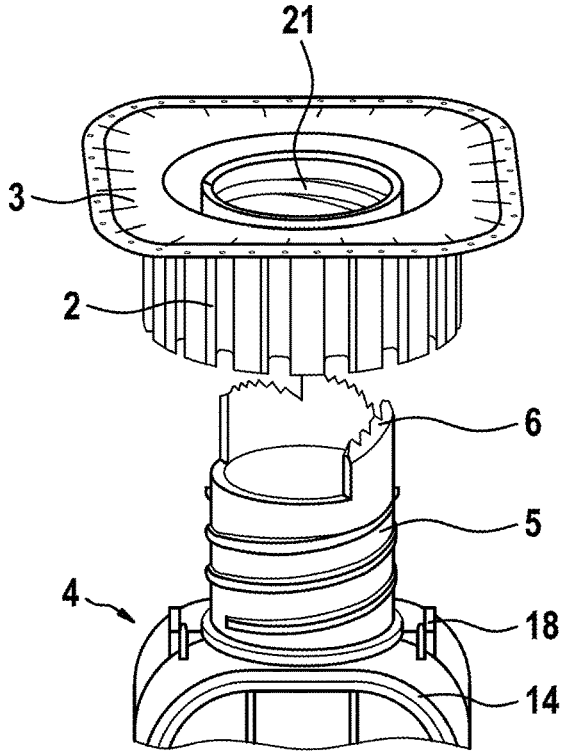

The filled tubular bag is already provided with a disposable pump 4. In FIG. 2, the disposable pump can partially be seen prior to the installation thereof with the nozzle 2, which is mounted to the tubular bag 1 by means of a flange 3.

The disposable pump 3 has a tubular inlet 5 on which an external thread 7 is tapped. The tubular inlet 5 is integrally formed on the pump tube 14. At the end remote from the pump housing, a cutting element 6 is installed in the tubular inlet 5. In the present case, the cutting element 6 has two or three terminal, canted and toothed cutting edges, by means of which the film of the tubular bag 1 can be perforated and cut. The tubular inlet comprising the external thread 7 is screwed into the nozzle 2, wherein the internal thread 21 in the nozzle engages with the external thread 7 on the tubular inlet 5. Safety stops, which are not depicted, on the disposable pump 4 do not allow the tubular inlet 5 to be screwed into the nozzle 2 to such an extent that said inlet comes into contact with the film of the tubular bag 1.

Figure 3:
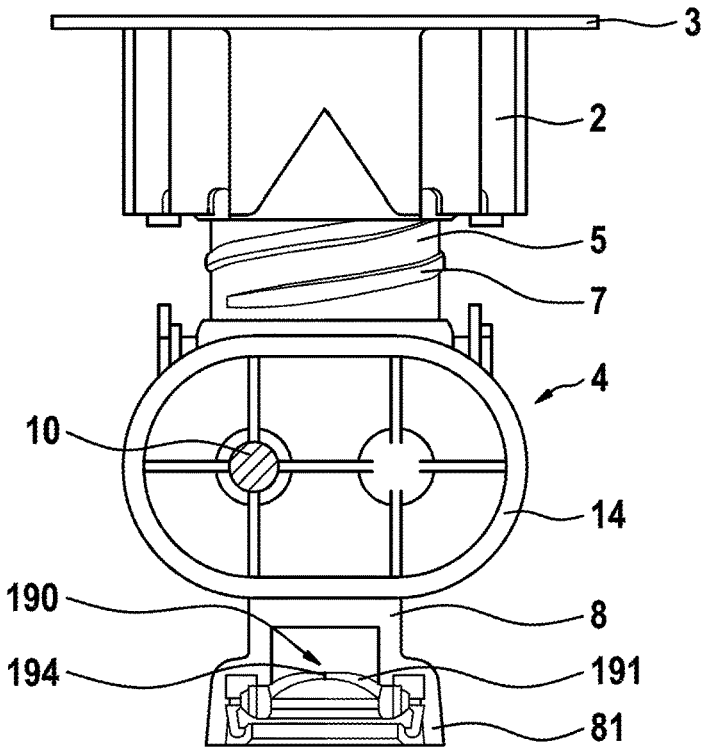
FIG. 3 shows the disposable pump screwed into the nozzle with the flange; however, before a perforation of the tubular bag can take place.

This transport position can be seen in FIG. 3. In FIG. 3, a drive shaft 10 can also be seen which can be coupled to a mechanical drive or by means of an electric motor. The drive shaft 10 of the disposable pump 4 as well as the output shaft of a mechanical drive or an electric motor can be put together by means of corresponding designs which can be fitted to one another in a positive-locking manner. An outlet tube 8, which is integrally connected to the pump housing 14 of the disposable pump can also be seen in FIG. 3. A valve 9 which closes the outlet tube 8 is mounted in or on said outlet tube 8. The possible embodiments of this closing valve 9 will be discussed later in the application.

Figure 4:
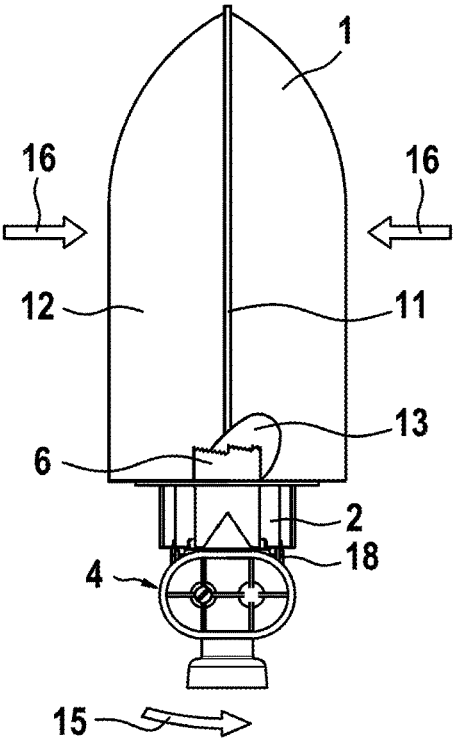
FIG. 4 shows the tubular bag together with the disposable pump in the ready-to-operate position.
Figure 5:
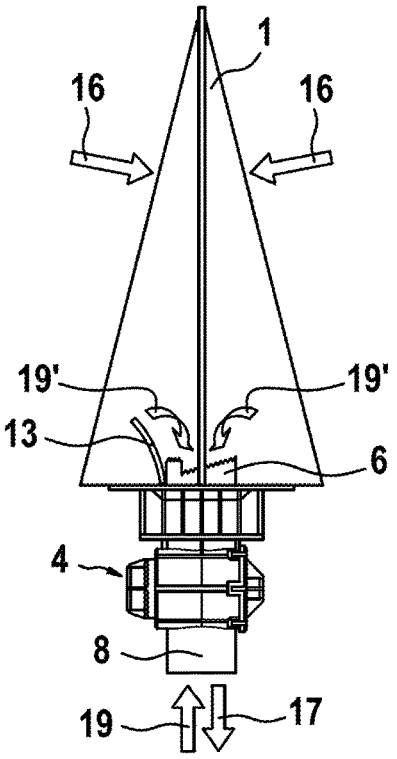
FIG. 5 shows the situation according to FIG. 4 in a position which has been rotated by 90°.

The first step of the method can now be seen in FIG. 4. The tubular bag 1 is depicted here rotated about an angle of 90° in relation to FIG. 1 such that the welded seam 11 extends practically down the center. The welded seam 11 cannot be seen at the lower end as said welded seam relates here to the rear welded seam because the tubular bag 1 is cut centrally in this case. The position depicted here illustrates the situation after the disposable pump 4 with the tubular inlet 5 thereof, on the end of which the cutting element 6 is integrally formed, has been completely screwed in such that said disposable pump 4 rests on top with supporting elements 18, which are integrally formed on the pump housing 14, against the nozzle 2. The cutting element 6 has now cut open the film of the tubular bag as a result of the rotational movement, so that a lobe 13 now protrudes inwards and is held away from the opening that has been cut open by means of the cutting element 6. This opening is made without air being able to enter into the tubular bag in the process. The ingredients 12 are in fact pressed through the hollow cylindrical cutting element 6 and the tubular inlet 5 into the disposable pump 4 by means of the atmospheric pressure applied to the tubular bag 1, symbolized by the arrows 16. This action is illustrated by the arrows 19' which are depicted in FIG. 5.

Upon being put into operation, the disposable pump 4 is now operated until a first quantity of the ingredients 12 is pressed out of the outlet tube 8. It is now ensured that there is no longer any air contained in the disposable pump 4 or, respectively, in the outlet tube 8. During the subsequent metering operation, the ingredients 12 now exit in the predefined metered quantity. This is symbolized by the arrow 17. If the individual metered quantities are relatively small, the pump is operated during the initial metering operation in such a way that said pump is operated in the continuous pumping state until a first quantity of unmetered ingredients 12 exits. If, however, the individual metered outlet quantities are relatively large, it is sufficient at the start to merely dispense one or two metered quantities before the system is ready for operation. The continuous operation is not a problem if the disposable pump is operated by means of an electric motor. If, however, this operation is carried out mechanically, for example by means of a lever, with which gears are in each case moved in a stepwise manner, a plurality of pumping thrusts are then required.

As soon as the disposable pump 4 is performing the normal metering operation, the disposable pump is now operated in the opposite rotational direction and thus carries out a suctioning movement. This is symbolized by the arrow 19. In so doing, the back suction volume is proportional to the reverse rotational movement. The back suction movement is carried out such that the back suction volume is less than the volume of the interior of the outlet tube 8. The back suction volume is preferably selected to be <10% of the volume of the outlet tube, wherein an even smaller back suction volume is for the most part sufficient. Hence, said back suction volume can also by all means be less than 10% of the volume of the ingredients 12 which is situated in the outlet pipe 8.

In many instances, the back suction volume could consequently relate to one which would involve only a few mm3. Such a small quantity cannot be suctioned back in many cases. As a result, the back suction volume is selected larger than that volume which is absolutely necessary. In order to implement this process, provision is made for a valve 9 to be arranged in the outlet tube 8 and to comprise a membrane which is sealingly mounted in a sliding manner or can be inverted. This has the effect that, during a back suction operation, either the valve closes or is suctioned back, already in the closed state, within the outlet tube 8 into the disposable pump by displacing or deforming the valve, thereby displacing additional ingredients 12 by a portion of the outlet tube volume out of said outlet tube 8 without air being able to enter into the outlet tube 8 or, respectively, into the disposable pump 4 or even into the tubular bag 1.

The configuration of such movable or deformable self-closing membrane valves are known per se in the area of plastic closures. In this regard, reference is particularly made to the European patent publication EP 1 958 883. Such a self-closing membrane valve, which adapts in shape, is also known from the European patent publication EP 0 743 259.

Figure 6:
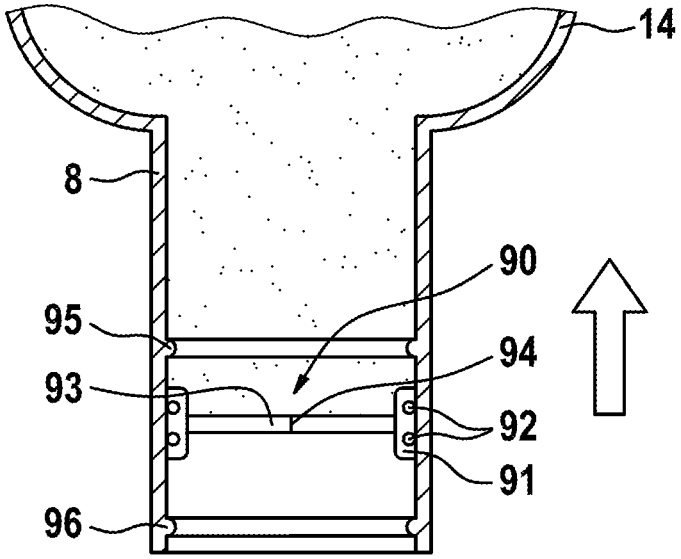
FIG. 6 constitutes a solution of an embodiment according to the invention which has a movable valve in the outlet tube under suction or, respectively, pressure conditions.
Figure 7:
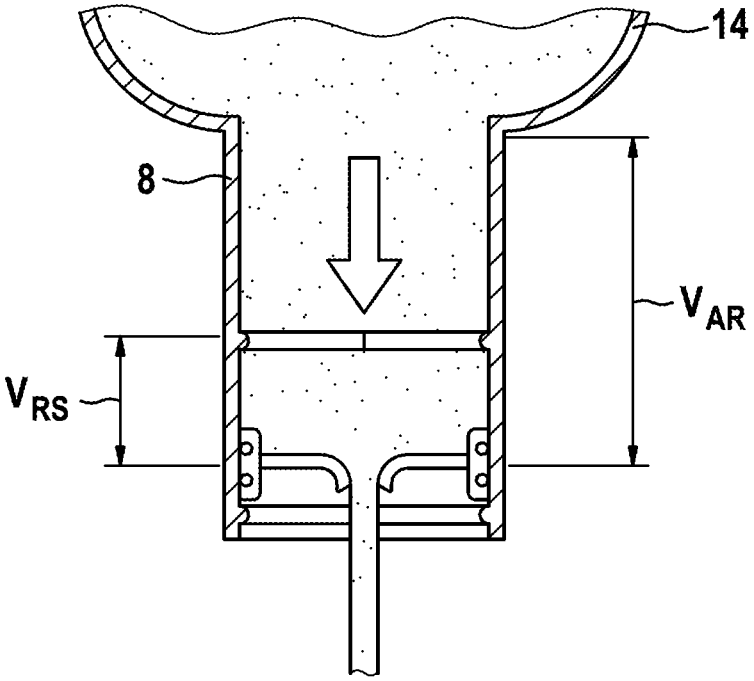
FIG. 7 shows this valve in the open state when dispensing a metered quantity of foodstuff.

In FIGS. 6 and 7, a valve is depicted as a movable valve 90 in two different positions. This movable valve 90 has a sliding ring 91, the outer diameter of which is slightly smaller than the diameter of the outlet tube 8. A membrane 93 is held in the sliding ring 91, said membrane having a slot 94 which opens when a certain pressure is applied thereto. In this case, the sliding ring 91 is provided with two O-ring seals 92 which seal said sliding ring 91 off from the outlet tube 8. In order to open the slot 94, a sufficient pressure has to first build up. This pressure is sufficient to set the sliding ring 91 with the membrane 93 into a downward movement. Only if the sliding ring 91 is able to abut against a lower stop bead 96, can the pressure be further raised until the slot 94 opens, whereupon a desired metered quantity of the ingredients 12 is dispensed, as this is symbolically shown in FIG. 7. As soon as the pump becomes inactive and the pressure thus decreases, the slot 94 of the membrane 93 closes and the pump is now operated in suction mode so that the residual foodstuffs present in the region of the slot 94 are suctioned in and then the closed valve 9 moves upward. A stop is also provided here which basically can be disposed practically in the upper end region of the outlet tube 8. However, since the back suction volume is in fact relatively small, the sliding ring 91 will also normally move only slightly in the direction of the stop, which is formed by an upper stop bead 95. In FIG. 7, the maximum back suction volume VRS is specified. The total volume of the outlet tube 8 is also delineated with the reference sign VAR.

Figure 8:
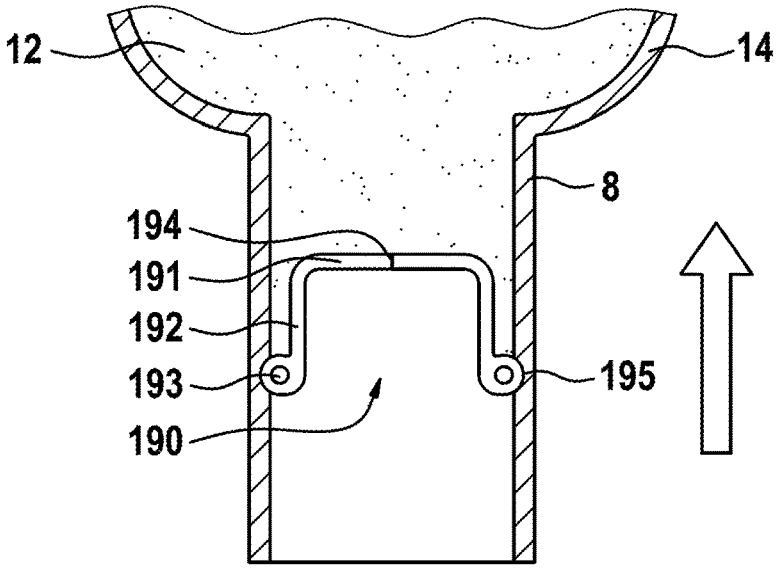
Figure 9:
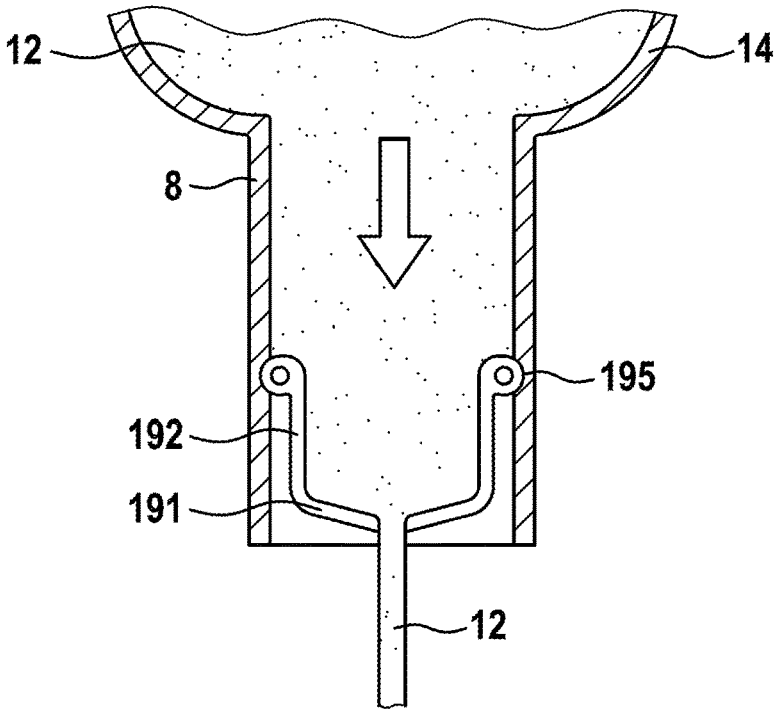
FIG. 9 shows this valve in the open position, i.e. when dispensing the tubular bag contents to be metered.

The size ratios which are greatly exaggerated here are only used to make the ratios clearly visible. This relates particularly to that embodiment which is shown in FIGS. 8 and 9. In this case, the valve which can be inverted or, respectively, deformed consists of an actual membrane 191, which comprises the membrane wall portions 192. The deformable valve 190 is held by means of a clamping ring at the free end or, respectively, the end of the membrane wall portions remote from the actual membrane 191. In order to form a secure support, a circumferential retaining groove can be formed on the inside wall of the outlet tube 8. The position according to FIG. 8 is that position which the valve can assume after the back suction process. This is, of course, the maximum deformation. After pressure has been built up by means of the disposable pump, the valve is inverted into the position according to FIG. 9; and as soon as the pressure increases further, the slot 194 in the actual membrane 191 opens and the ingredients 12 are dispensed in a metered manner.

Such a valve which can be inverted or deformed is depicted in a realistic design in FIG. 3. This relates to a valve which, for example, corresponds to the variant according to the European patent publication EP 1 958 883. In order to easily install the aforementioned valve, the outlet tube 8 has a circumferential collar 81. A thickening of the valve is held in a positive-locking and/or force-fitting manner in the interstice between the outlet tube 8 and the circumferential collar 81. Under pressure, the membrane 191 arches from the position depicted here downwards and the slot in the membrane opens. As soon as the disposable pump is rotated into the suctioning direction, the membrane with the closed slot is moved back to the position according to FIG. 3.

It goes without saying that, when carrying out the method, the metered quantity can have slight deviations due to the valve 9, which is either a movable valve 90 or a deformable valve 190. This is, however, not relevant here. A metering down to the exact gram generally does not apply to the food service industry. It is of far greater importance that the metering allows the foodstuff to be dispensed cleanly in at least a virtually aseptic manner without air being introduced into the tubular bag in the process.

LIST OF REFERENCE SIGNS

1 tubular bag
2 nozzle
3 flange
4 disposable pump
5 inlet, tubular
6 cutting element
7 external thread
8 outlet tube
81 circumferential collar
9 valve
10 drive shaft
11 welded seam
11' upper welded seam
12 ingredients
13 lobe of the tubular bag
14 pump housing
15 arrow: rotational direction for operating the cutting element
16 arrow: atmospheric pressure on the tubular bag
17 arrow: exit of the metered quantity of the ingredients 12
18 support element on the pump housing 14
19 arrow: suction direction
81 circumferential collar
90 movable valve
91G sliding ring
92 O-ring seals
93 membrane
94 slot
95 upper stop bead
96 lower stop bead
97 valve which can be inverted or deformed
191 membrane
192 membrane wall portion
193 clamping ring
194 slot
195 circumferential retaining groove
VAR=volume of the outlet tube
VRS=maximum back suction volume

What is claimed is:

1. A method for dispensing viscous or pasty ingredients from a tubular bag by means of a rotary disposable pump (4) attached to the bag, wherein the ingredients are packaged in an aseptic manner, wherein the bag is closed prior to a first use, wherein the rotary disposable pump (4) includes an inlet (5) having a cutting element (6) connected to the rotary disposable pump in a rotationally fixed manner, wherein the inlet (5) has an external thread (7) which is connected in a nozzle (2) having a flange (3) that is attached to the tubular bag (1), and wherein an outlet of the rotary disposable pump (4) is an outlet tube (8) having a valve (9) which closes in a sealing manner, wherein the valve (90) includes a membrane (93) with a sliding ring (91), the method comprising:

rotating the rotary disposable pump (4) including the cutting element (6) in a first step prior to an initial metering operation until the cutting element (6) has cut open the tubular bag (1), operating the rotary disposable pump (4) in a rotational direction until the ingredients (12) of a freely selectable volume have exited the valve (9) and the membrane (91) and sliding ring (91) have moved in a sealing and sliding manner to a first position, and subsequently operating the rotary disposable pump (4) in a direction opposite the rotational direction until at least the ingredients (12) present in a region of the valve (9) are suctioned back into the outlet tube (8) and the membrane (91) and sliding ring (93) have moved in a sealing and sliding manner to a second, different position, wherein the valve (9) reaches or remains in a closed valve state during the operating of the rotary disposable pump (4) in the direction opposite the rotational direction.

2. The method according to claim 1, wherein the valve (9) in the closed state is suctioned back within the outlet tube (8) into the rotary disposable pump (4) by displacing or deforming the valve (9), thereby displacing ingredients (12) back into an outlet tube volume ($V_{AR}$) as a back suction volume ($V_{RS}$).

3. The method according to claim 2, wherein the back suction volume ($V_{RS}$) is kept smaller than the outlet tube volume ($V_{AR}$).

4. The method according to claim 2, wherein the back suction volume ($V_{RS}$) is smaller than 10% of the outlet tube volume ($V_{AR}$).

5. The method according to claim 1, further comprising guiding the sliding ring (91) in the outlet tube (8) by means of at least one O-ring.

6. The method according to claim 1, wherein in the second position the stop ring (91) contacts an upper stop bead (95) in the outlet tube (8) and wherein in the first position the stop ring (91) contacts a lower stop bead (96) in the outlet tube (8).

7. The method according to claim 1, wherein the outlet tube (8) is provided with an integrally formed collar, which is open at a bottom of the collar, on an outlet side.

8. The method according to claim 1, wherein the sliding ring is a rubber elastic ring which is integrally formed with the membrane (93, 191).

* * * * *